US005611894A

United States Patent [19]

Kawamura et al.

[11] Patent Number: 5,611,894

[45] Date of Patent: Mar. 18, 1997

[54] METHOD AND APPARATUS FOR CHANGING SOLVENT COMPOSITION IN A SOLVENT RECOVERY SYSTEM OF A DEWAXING APPARATUS

[75] Inventors: Akira Kawamura, Kanagawa; Susumu Suzuki, Yokosuka; Masahumi Imamura, Yokohama, all of Japan

[73] Assignee: Nippon Petroleum Refining Company Limited, Tokyo, Japan

[21] Appl. No.: 483,067

[22] Filed: Jun. 7, 1995

Related U.S. Application Data

[62] Division of Ser. No. 294,706, Aug. 23, 1994.

[30] Foreign Application Priority Data

Aug. 27, 1993 [JP] Japan ..... 5-212887

[51] Int. Cl.[6] ..... C10G 73/00; B01D 11/00

[52] U.S. Cl. ..... 196/14.5; 196/14.52; 208/33; 208/35

[58] Field of Search ..... 196/14.5, 14.52; 208/33, 35; 210/650, 654, 772

[56] References Cited

U.S. PATENT DOCUMENTS

| | | | |
|---|---|---|---|
| 3,443,391 | 5/1969 | Storment et al. | 196/14.5 X |
| 3,565,786 | 2/1971 | Brown et al. | 196/14.5 X |
| 3,972,779 | 8/1976 | Harrison | 196/14.52 |
| 4,088,564 | 5/1978 | Perry et al. | 208/33 |
| 4,216,075 | 8/1980 | Ryan | 203/33 |
| 5,173,191 | 12/1992 | Black | 210/654 |
| 5,306,433 | 4/1994 | Leach | 210/772 |

FOREIGN PATENT DOCUMENTS

| | | |
|---|---|---|
| 440274 | 4/1972 | Australia . |
| 576346A1 | 12/1993 | European Pat. Off. . |

*Primary Examiner*—Christopher Kim

*Attorney, Agent, or Firm*—Lowe, Price, LeBlanc & Becker

[57] ABSTRACT

An apparatus for changing the solvent composition in a solvent recovery system of a dewaxing apparatus, depending on the type of stock oil, by introducing a part of dry solvent into a wet solvent tank to thereby increase or decrease a concentration of MEK in the wet solvent used as a primary solvent for initially mixing with the stock oil.

3 Claims, 2 Drawing Sheets

METHOD AND APPARATUS FOR CHANGING SOLVENT COMPOSITION IN A SOLVENT RECOVERY SYSTEM OF A DEWAXING APPARATUS

This application is a division of application Ser. No. 08/294,706 filed Aug. 23, 1994.

BACKGROUND OF THE INVENTION

1. Field of the Invention

The present invention relates to a method and apparatus for changing the composition of a solvent in a solvent recovery system of a dewaxing apparatus, and in particular to a method and apparatus applicable to the solvent recovery system of an MEK (methyl ethyl ketone) dewaxing apparatus, for increasing or decreasing the concentration of MEK in a primary solvent which is initially mixed with the stock oil.

2. Description of the Related Art

Heretofore with known MEK dewaxing apparatus, wax and lubricating oil is produced by mixing a solvent mixture of MEK and toluene with stock oil, and then cooling the mixture and filtering.

In such MEK dewaxing apparatus, the different properties of the MEK and toluene are used in producing the wax and lubricating oil from the stock oil.

More specifically, the properties of MEK and toluene are such that MEK does not readily dissolve wax, while toluene readily dissolves both lubricating oil and wax. These properties are used in the production of low freezing point lubricating oil where the wax is first crystallized out from the stock oil in the cooling process and then filtered out with a filter.

The constituent proportions of the MEK and toluene are thus extremely important factors in the operation of the dewaxing apparatus.

If the proportion of MEK in the solvent is larger, the dewaxing temperature difference becomes smaller, and the lubricating oil yield is also improved. However if the MEK proportion is too great then oil separation can occur during filtering.

Normally the wax of low viscosity stock oil is n-paraffin based which is easily separated from the oil constituent, and hence the proportion of MEK is made large. With high viscosity stock oil however, the wax is mainly i-paraffin which is difficult to separate from the oil constituent, and hence the proportion of toluene is made large. Since the oil is dissolved in the toluene, the wax must then be separated out by precipitation.

Therefore under actual operation of the dewaxing apparatus, for optimum conditions as shown in FIG. 2 with for example the low viscosity stock oil such as S/L (Sumatra light type stock oil)—No. 10, 20 (SAE equivalent), or HDC (hydro-cracking type stock oil) No. 70 pale, 10 (SAE equivalent), the proportion of MEK is made approximately 65%, while with high viscosity stock oil such as HDC- No. 20 (SAE equivalent) and oils in wax de-oiling operations etc., the proportion of MEK is made approximately 55%.

With an ordinary dewaxing apparatus, since similar kinds of stock oil distilled from the low pressure distillation apparatus are processed, there is no real need to change the proportion of MEK and toluene significantly.

However, for cases where the stock oil for processing in the dewaxing apparatus covers many varieties such as; straight run S/L type stock oil distributed from the low pressure distillation apparatus, Middle East cracked stock oil obtained by low pressure distillation of the HDC bottoms, or wax stock oil, if the solvent composition remains the same, then due to the above-mentioned reasons, there is a reduction for example in yield and/or filterability depending on the type of stock oil, so that a low efficiency of the dewaxing operation is unavoidable.

It is therefore necessary to change the solvent composition to suit the stock oil to be processed. However, since the dewaxing apparatus comprises a cooling/precipitation system, a filtration system, and a recovery system, and the solvent is circulated through all these systems, then to change the solvent composition in the circulation circuit requires large scale modification of the equipment and the addition of a complex solvent composition changing apparatus. There is also the requirement for a complicated solvent composition changing operation and solvent control. Hence in addition to increased equipment costs there is also a deterioration in operability and controllability.

SUMMARY OF THE INVENTION

In view of the above mentioned problems, it is an object of the present invention to provide a method of changing the solvent composition in a solvent recovery system of a dewaxing apparatus, depending on the type of stock oil, to thereby improve yield and filtration performance, so that the dewaxing operation can be efficiently carried out.

It is a further object of the present invention to provide an apparatus of simple construction and operation whereby the above method of changing solvent composition can be performed.

To achieve the above objectives, the present invention provides a method of changing the solvent composition in a solvent recovery system of a dewaxing apparatus which is used for manufacturing wax and lubricating oil by mixing a mixed solvent of MEK and toluene with stock oil, cooling the mixture and filtering, and which comprises a lubricating oil/solvent recovery system for recovering lubricating oil and solvent by introducing thereto a lubricating oil which has been mixed with the mixed solvent, and evaporating off the solvent from the lubricating oil, and a wax/solvent recovery system for recovering wax and solvent by introducing thereto a wax which has been mixed with the mixed solvent, and evaporating off the solvent from the wax. With the method, the concentration of MEK in the wet solvent used as the primary solvent for initially mixing with the stock oil, is increased or decreased by mixing a part of the dry solvent from the lubricating oil/solvent recovery system with the wet solvent recovered from the wax/solvent recovery system.

With the dewaxing apparatus it is essential that the wax in the stock oil is well crystallized. Hence the primary solvent, which is initially mixed with the stock oil, should be one which can exert the most influence on the crystals.

Accordingly, mixing a part of the dry solvent with the wet solvent which is used as the primary solvent for initially mixing with the stock oil, results in an increase or decrease in the MEK concentration in the wet solvent. The solvent composition can thus be changed to a certain degree depending on the type of stock oil to be processed.

Hence, during the processing of, for example, S/L type stock oil and HDC type stock oil, the respective wax crystals thereof can be grown to an optimum size for filtering. The filtration effectiveness of the subsequent filter system can thus be improved, and a product of good quality can be obtained with consistently high yield.

To achieve the above objectives the present invention provides an apparatus for changing the solvent composition in a solvent recovery system of a dewaxing apparatus which is used for manufacturing wax and lubricating oil by mixing a mixed solvent of MEK and toluene with stock oil, cooling the mixture and filtering. The apparatus comprises; a lubricating oil/solvent recovery system, a wax/solvent recovery system, a dry solvent tank, a wet solvent tank, and a dry solvent distribution device. The lubricating oil/solvent recovery system recovers lubricating oil and solvent by introducing thereto a lubricating oil which has been mixed with the mixed solvent, and evaporating off the solvent from the lubricating oil. The wax/solvent recovery system recovers wax and solvent by introducing thereto a wax which has been mixed with the mixed solvent and evaporating off the solvent from the wax. The dry solvent tank receives the solvent recovered in the lubricating oil/solvent recovery system and the solvent recovered in the wax/solvent recovery system, and the wet solvent tank receives the solvent recovered in the wax/solvent recovery system and the solvent recovered in the lubricating oil/solvent recovery system. The dry solvent distribution device distributes to the wet solvent tank, a part of the dry solvent from the lubricating oil/solvent recovery system.

With such an apparatus, the lubricating oil which has been mixed with mixed solvent is introduced to the lubricating oil/solvent recovery system, where the lubricating oil and solvent are recovered by evaporating off the solvent from the lubricating oil. Furthermore, the wax which has been mixed with mixed solvent is introduced to the wax/solvent recovery system, where the wax and solvent are recovered by evaporating off the solvent from the wax.

The solvent recovered in the lubricating oil/solvent recovery system, is passed to the dry solvent tank, while the solvent recovered in the wax/solvent recovery system is passed to the wet solvent tank.

When a part of the dry solvent from the lubricating oil/solvent recovery system is distributed to the wet solvent tank, the concentration of the MEK in the wet solvent which is used for the primary solvent which is initially mixed with the stock oil, is increased or decreased.

In particular, the lubricating oil/solvent recovery system may comprise first, second, and third recovery towers for recovering lubricating oil and solvent, the towers being connected in series in the order of reducing concentration of MEK in the solvent to be evaporated. The wax/solvent recovery system may comprise fourth, fifth and sixth recovery towers for recovering wax and solvent, the towers also being connected in series in the order of reducing concentration of MEK in the solvent to be evaporated. The dry solvent tank may receive the solvent recovered from the respective first, second and fifth recovery towers, and the wet solvent tank may receive the solvent recovered from the respective third, fourth and sixth recovery towers.

With such a construction, a part of the dry solvent from the first recovery tower or the second recovery tower is merely passed to the wet solvent tank. Hence it is not necessary to add a complex solvent composition changing device. Modification of the equipment on a large scale is also not required, and neither is there a requirement for a complicated solvent composition changing operation and solvent control. Hence as well as enabling a reduction in equipment costs, operability and controllability can be improved.

The dry solvent distribution device may comprise respective pipes branching from along the solvent recovery piping of the respective first and second recovery towers, these branch pipes being connected to the wet solvent tank, with shut-off valves provided in each.

As a result, a part of the dry solvent can be introduced to the wet solvent tank by simply opening and closing the shut-off valves.

The dry solvent in the dry solvent tank is preferably supplied to relevant locations as a secondary solvent for reflux use in temperature adjustment and for cold wash use in washing the wax, and is also supplied to the wet solvent tank for normal make-up.

When a part of the dry solvent is introduced to the set solvent tank and the composition of the wet solvent in the wet solvent tank changes, the amount of the dry solvent introduced to the dry solvent tank changes and the composition of the dry solvent in the dry solvent tank also changes. However, since the dry solvent is used as a secondary solvent for reflux and for cold wash, any changes in its composition have no effect.

The present invention may be more fully understood by the following detailed description based on the embodiment illustrated in the drawings. The present invention however is not limited to this embodiment, and can be freely modified within the scope of the claims.

DETAILED DESCRIPTION OF THE PREFERRED EMBODIMENT

The dewaxing apparatus for manufacturing wax and lubricating oil by mixing a mixed solvent of MEK and toluene with stock oil, and then cooling the mixture and filtering, comprises a cooling/precipitation system, a filtration system, and a recovery system.

Figure 1:
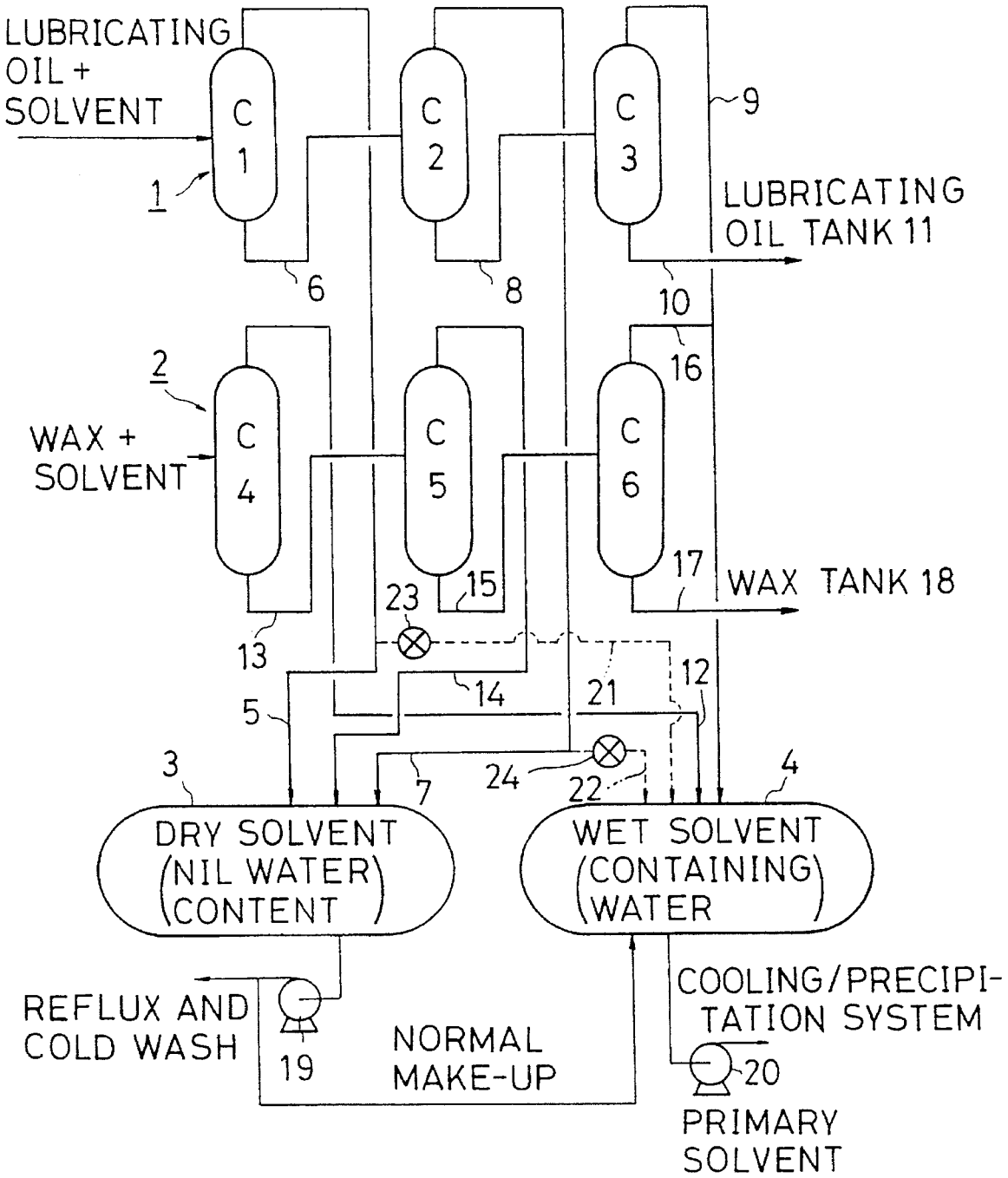
FIG. 1 is a schematic diagram of a dewaxing apparatus recovery system, illustrating an embodiment of an apparatus for carrying out a method of the present invention.
Figure 2:
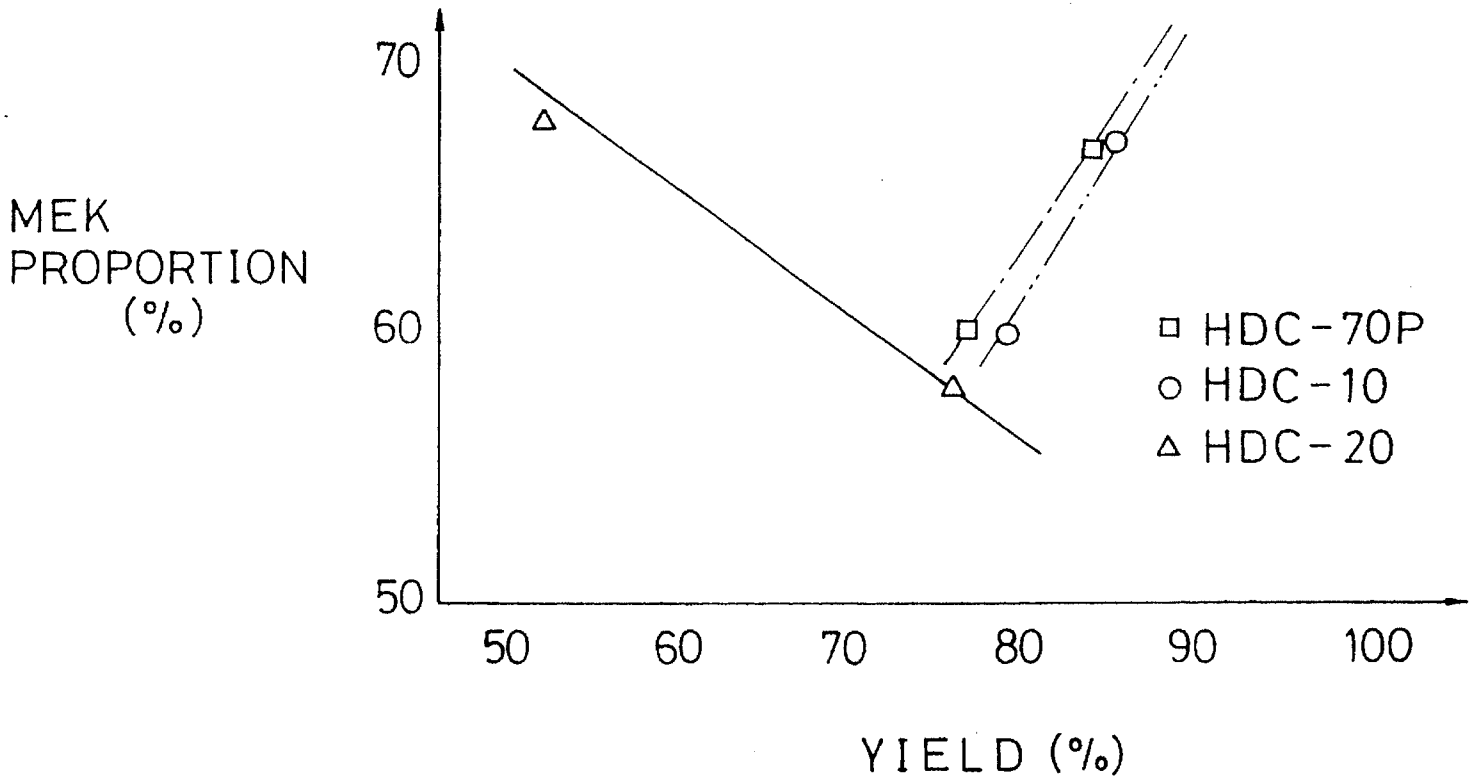
FIG. 2 is a characteristic diagram illustrating a relationship between MEK proportion and yield, for different types of stock oil.

The recovery system of such apparatus is shown in FIG. 1, and incorporates a lubricating oil/solvent recovery system 1, a wax/solvent recovery system 2, a dry solvent tank 3, and a wet solvent tank 4. The lubricating oil/solvent recovery system 1 comprises first, second, and third recovery towers C1, C2 and C3 for recovering lubricating oil and solvent by introducing thereto lubricating oil which has been mixed with solvent, and evaporating off the solvent from the lubricating oil. These towers are connected in series in the order of reducing concentration of MEK in the solvent to be evaporated. The wax/solvent recovery system 2 comprises fourth, fifth and sixth recovery towers C4, C5, C6 for recovering wax and solvent by introducing thereto wax which has been mixed with solvent, and evaporating off the solvent from the wax. These towers also are connected in series in the order of reducing concentration of MEK in the solvent to be evaporated. The dry solvent tank 3 receives the solvent recovered from the respective first, second and fifth recovery towers C1, C2 and C5, while the wet solvent tank 4 receives the solvent recovered from the respective third, fourth and sixth recovery towers C3, C4 and C6.

As shown in FIG. 1, a top portion of the first recovery tower C1 of the lubricating oil/solvent recovery system 1 is connected by way of a first solvent recovery pipe 5 to the dry solvent tank 3, while a bottom portion thereof is connected by way of a first lubricating oil recovery pipe 6 to the second recovery tower C2.

A top portion of the second recovery tower C2 is connected by way of a second solvent recovery pipe 7 to the dry solvent tank 3, while a bottom portion thereof is connected by way of a second lubricating oil recovery pipe 8 to the third recovery tower C3.

A top portion of the third recovery tower C3 is connected by way of a third solvent recovery pipe 9 to the wet solvent tank 4, while a bottom portion thereof is connected by way of a third lubricating oil recovery pipe 10 to a lubricating oil tank 11.

A top portion of the fourth recovery tower C4 is connected by way of a fourth solvent recovery pipe 12 to the wet solvent tank 4, while a bottom portion thereof is connected by way of a first wax recovery pipe 13 to the fifth recovery tower C5.

A top portion of the fifth recovery tower C5 is connected by way of a fifth solvent recovery pipe 14 to the dry solvent tank 3, while a bottom portion thereof is connected by way of a second wax recovery pipe 15 to the sixth recovery tower C6.

A top portion of the sixth recovery tower C6 is connected by way of a sixth solvent recovery pipe 16 to the wet solvent tank 4, while a bottom portion thereof is connected by way of a third wax recovery pipe 17 to a wax tank 18. The dry solvent (nil water content) in the dry solvent tank 3 is supplied by a pump 19 to relevant locations as a secondary solvent for reflux use in temperature adjustment, and for cold wash use in washing the wax, and is also supplied to the wet solvent tank 4 for normal make-up. The composition of the dry solvent is approximately MEK 63%, toluene 37%.

The wet solvent (containing water) in the wet solvent tank 4 is supplied by a pump 20 to the cooling/precipitation system of the dewaxing apparatus as a primary solvent for initial mixing with the stock oil. The composition of the wet solvent is approximately MEK 64%, toluene 36%.

An example of the composition of the solvent taken off from the respective recovery towers C1 to C6 of the above constructed recovery system is given in Table 1.

TABLE 1

| | MEK | Toluene | Recovery amount | Receiver |
|---|---|---|---|---|
| | | Lubricating oil recovery system | | |
| C1 | 74% | 26% | 37 KL/H | dry solvent |
| C2 | 52% | 48% | 9 KL/H | dry solvent |
| C3 | 29% | 71% | 2 KL/H | wet solvent |
| | | Wax recovery system | | |
| C4 | 75% | 25% | 9 KL/H | wet solvent |
| C5 | 50% | 50% | 7 KL/H | dry solvent |
| C6 | 30% | 70% | 2 KL/H | wet solvent |

As is clear from Table 1, the first and second recovery towers C1, and C2 show a large solvent recovery amount, and a significant difference in the proportions of MEK.

Normally the solvent from the first and second recovery towers C1 and C2 is received in the dry solvent tank 3 as a dry solvent. However, by receiving this in the wet solvent tank 4 which stores the wet solvent used as the primary solvent for initially mixing with the stock oil, the concentration of the MEK in the wet solvent can be increased or decreased to thus change the solvent composition.

With the construction as shown in FIG. 1 for carrying out the method of changing solvent composition, a pipe 21 branches from along the first solvent recovery pipe 5, and a pipe 22 branches from along the second solvent recovery pipe 7. These branch pipes 21, 22 are connected to the wet solvent tank 4 and are provided with respective shut-off valves 23, 24.

As follows is a description of a method of operating the dewaxing apparatus to increase or decrease the concentration of MEK in the wet solvent.

When the stock oil is replaced, the quantity of solvent pumped into the apparatus is increased (solvent ratio goes from 0.8 to 1.5), while replacing the stock oil and washing the heat exchanger and chiller in the cooling/precipitation system, and the temperature for heating the stock oil rises (heat exchanger inlet temperature approximately 60° C.).

On completion of the work mentioned above (30 to 60 minutes) the destination of the distribution from the first recovery tower C1 or the second recovery tower C2 of the recovery system shown in FIG. 1 is changed from the normal dry tank 3 to the wet tank 4.

The replacement is fully completed in approximately 30 to 60 minutes after replacement of the stock oil, and after approximately 2 hours the composition of the wet solvent in the wet solvent tank 4, which is used as the primary solvent, changes to an optimum composition for the stock oil.

Test results of the present inventors with the recovery system of FIG. 1 showed that when a part of the solvent of the first recovery tower C1 was introduced to the wet solvent, the composition of the wet solvent during normal operation changed from approximately 64% MEK and 36% toluene, to approximately 65% MEK, and 35% toluene.

Furthermore, when a part of the solvent of the second recovery tower C2 was introduced to the wet solvent, the composition of the wet solvent changed to approximately 55% MEK and 45% toluene.

Table 2 shows the change in composition of the solvent in the dry solvent tank and the wet solvent tank with elapsed time from replacing the stock oil, for the case where a part of the solvent from the second recovery tower is introduced to the wet solvent. The table shows that the composition of the wet solvent is changed in approximately 2 hours.

At this time the composition of the dry solvent also changes due to the change in amount of the dry solvent introduced to the dry solvent tank. However, since the dry solvent is used as a secondary solvent as mentioned above, for reflux and for cold wash, any changes in its composition have no effect.

TABLE 2

| Solvent destination | dry solvent tank 3 | | wet solvent tank 4 | |
|---|---|---|---|---|
| Solvent composition | Toluene | MEK | Toluene | MEK |
| Before starting test | 35.5% | 64.5% | 36.0% | 64.0% |
| 1 hr after starting test | 32.5% | 67.5% | 41.1% | 58.9% |
| 2 hrs after | 32.5% | 67.5% | 43.8% | 56.2% |
| 3 hrs after | 32.5% | 67.5% | 43.8% | 56.2% |
| 4 hrs after | 32.5% | 67.5% | 43.8% | 56.2% |

The above described method of changing solvent composition has the following advantages.

With the dewaxing apparatus it is essential that the wax in the stock oil is well crystallized. Hence the primary solvent which is initially mixed with the stock oil should be one which has the most influence on the crystals.

Accordingly, by passing the solvent from the first and second recovery towers C1 and C2 to the wet solvent tank 4 which stores the wet solvent used as the primary solvent for initially mixing with the stock oil, the concentration of the MEK in the wet solvent can be increased or decreased. The solvent composition can thus be changed to a certain degree depending on the type of stock oil to be processed.

For example when processing S/L type stock oil, by introducing a part of the solvent of the first recovery tank C1 to the wet solvent as described above, the composition is changed to approximately 65% MEK and 35% toluene, while when processing HDC type stock oil, by introducing a part of the solvent of the second recovery tank C2 to the wet solvent as described above, the composition is changed to approximately 55% MEK and 45% toluene. As a result, when processing S/L type stock oil or HDC type stock oil, the wax crystals in each can be grown to the optimum size for the filtering. The filtration effectiveness of the subsequent filter system can thus be improved, and a product of good quality can be obtained with consistently high yield.

Moreover, with such a solvent composition change apparatus, a part of the dry solvent from the first recovery tower C1 or the second recovery tower C2 is merely passed to the wet solvent tank 4. Hence it is not necessary to add a complex solvent composition changing apparatus. Modification of the equipment on a large scale is also not required, and neither is there a requirement for a complicated solvent composition changing operation and solvent control. Hence as well as enabling a reduction in equipment costs, operability and controllability can be improved.

What is claimed is:

1. Apparatus for changing the solvent composition in a solvent recovery system of a dewaxing apparatus which is used for manufacturing wax and lubricating oil by mixing a mixed solvent of MEK and toluene with stock oil, cooling the mixture and filtering and which consisting essentially of: A) a lubricating oil and solvent recovery system, B) a wax and solvent recovery system, C) a dry solvent tank, D) a wet solvent tank, and E) dry solvent distribution means, wherein means are provided for introducing a lubricating oil and mixed MEK/toluene solvent into said A) lubricating oil and solvent recovery system and for evaporating off said solvent from the lubricating oil, said recovered dry solvent being conducted by a pipe to C) the dry solvent tank, which also receives dry solvent via a pipe from B) said wax and solvent recovery system, where solvent is separated from wax by evaporation, the D) wet solvent tank similarly receiving wet solvent by way of pipes from the two recovery systems A) and B), while said E) dry solvent distribution means transmits dry solvent as make-up to maintain the amount of solvent in said D) wet solvent tank, conducts lubricating oil to a lubricating oil tank, and supplies dry solvent for reflux use in temperature adjustment and for cold wash use in washing the wax in the B) wax and solvent recovery system, wherein the dry solvent in said C) dry solvent tank is supplied as a secondary solvent for reflux use in temperature adjustment and for cold wash use in washing the wax, and is also supplied to the D) wet solvent tank for normal make-up.

2. Apparatus for changing the solvent composition in a solvent recovery system of a dewaxing apparatus which is used for manufacturing wax and lubricating oil by mixing a mixed solvent of MEK and toluene with stock oil, cooling the mixture and filtering and which comprises: A) a lubricating oil and solvent recovery system, B) a wax and solvent recovery system, C) a dry solvent tank, D) a wet solvent tank, and E) dry solvent distribution means, wherein means are provided for introducing a lubricating oil and mixed MEK/toluene solvent into said A) lubricating oil and solvent recovery system and for evaporating off said solvent from the lubricating oil, said recovered dry solvent being conducted by a pipe to C) the dry solvent tank, which also receives dry solvent via a pipe from B) said wax and solvent recovery system, where solvent is separated from wax by evaporation, the D) wet solvent tank similarly receiving wet solvent by way of pipes from the two recovery systems A) and B), while said E) dry solvent distribution means transmits dry solvent as make-up to maintain the amount of solvent in said D) wet solvent tank, conducts lubricating oil to a lubricating oil tank, and supplies dry solvent for reflux use in temperature adjustment and for cold wash use in washing the wax in the B) wax and solvent recovery system, wherein said A) lubricating oil and solvent recovery system comprises first, second, and third recovery towers for recovering lubricating oil and solvent, said towers being connected in series in the order of reducing concentration of MEK in the solvent to be evaporated, said B) wax and solvent recovery system comprises fourth, fifth and sixth recovery towers for recovering wax and solvent, said towers also being connected in series in the order of reducing concentration of MEK in the solvent to be evaporated, said C) dry solvent tank receives the solvent recovered from the respective first, second and fifth recovery towers and said D) wet solvent tank receives the solvent recovered from the respective third, fourth and sixth recovery towers.

3. An apparatus for changing the solvent composition in a solvent recovery system of a dewaxing apparatus as claimed in claim 2, wherein said dry solvent distribution means comprises respective pipes branching from along solvent recovery piping of the respective first and second recovery towers, each branch pipe being connected to the wet solvent tank, with shut-off valves provided in each branch pipe.

* * * * *